US005505372A

United States Patent [19]

Edson et al.

[11] Patent Number: 5,505,372

[45] Date of Patent: Apr. 9, 1996

[54] CARTON BLANK AND CARTON

[75] Inventors: Patrick Edson, Lakewood; Raymond S. Kastanek, Longmont, both of Colo.

[73] Assignee: Graphic Packaging Corporation, Paoli, Pa.

[21] Appl. No.: 331,013

[22] Filed: Oct. 28, 1994

[51] Int. Cl.[6] ..... B65D 5/54; B65D 5/63

[52] U.S. Cl. ..... 229/121; 229/122; 229/235; 229/239; 229/242; 229/244

[58] Field of Search ..... 229/103.2, 121, 229/122, 122.1, 235, 239, 242, 243, 244

[56] References Cited

U.S. PATENT DOCUMENTS

| | | | |
|---|---|---|---|
| 2,138,019 | 11/1938 | Benoit | 229/121 |
| 3,157,344 | 11/1964 | Hennessey | 229/244 |
| 3,263,861 | 8/1966 | Carr | 229/122.1 |
| 3,300,115 | 1/1967 | Schauer | 229/121 |
| 3,933,303 | 1/1976 | Kirby, Jr. | 229/243 |
| 4,396,143 | 8/1983 | Killy | 229/122.1 |
| 4,577,799 | 3/1986 | Oliff | 229/122 |
| 4,958,734 | 9/1990 | Wood et al. | 229/122 |
| 5,284,291 | 2/1994 | Sellors | 229/242 |
| 5,297,725 | 3/1994 | Sutherland | 229/244 |
| 5,320,277 | 6/1994 | Stout et al. | 229/242 |

FOREIGN PATENT DOCUMENTS

| | | | |
|---|---|---|---|
| 9313993 | 7/1993 | WIPO | 229/122 |

*Primary Examiner*—Gary E. Elkins
*Attorney, Agent, or Firm*—Klaas, Law, O'Meara & Malkin; Joseph J. Kelly

[57] ABSTRACT

A carton formed from a carton blank comprising a unitary sheet of material having cut out portions, cut lines, fold lines and perforations to form various panels which are folded together to form a carton wherein the perforations are located so that a person has a choice of forming an opening from a plurality of locations.

8 Claims, 2 Drawing Sheets

CARTON BLANK AND CARTON

FIELD OF THE INVENTION

This invention relates generally to carton blanks and cartons formed therefrom and more particularly to carton blanks and cartons formed therefrom having perforations for providing a choice of forming one of a plurality of possible openings in the carton.

BACKGROUND OF THE INVENTION

Cartons are used extensively in the marketing of beverage containers. Each variety of cartons is provided with some means for forming an opening in the carton. However, it is not unusual that the opening is not located where the purchaser wants it to be and could cause enough frustration that the purchaser would change brands of beverages to obtain a desired carton.

BRIEF DESCRIPTION OF THE INVENTION

This invention provides a carton blank and a carton formed therefrom which carton has opening forming perforations at spaced apart locations so that a purchaser has a choice of forming an opening where desired.

In a preferred embodiment of the invention, the carton formed from the carton blank comprises a top wall panel comprising first and second portions secured together by a glue tab panel. A front panel is integral with the first portion of the top panel and is connected thereto by a fold line. A bottom panel is integral with the front panel and is connected thereto by a fold line. A back panel is integral with the bottom panel and is connected thereto by a fold line and the back panel is also integral with the second portion of the top panel and is connected thereto by a fold line. A left side panel comprises a first portion integral with the first portion of the top panel and connected thereto by a fold line, a second portion integral with the bottom panel and connected thereto by a fold line, a third portion integral with the second portion of the top panel and connected thereto by a fold line, a first glue panel integral with the glue panel integral with the first portion of the top panel and connected thereto by a fold line and secured to a portion of the third portion of the left side panel, a second glue tab panel integral with the front panel and connected thereto by a fold line and secured to portions of the first and second portions of the left side panel and a third glue tab panel integral with the back panel and connected thereto by a fold line and secured to the third portion and a portion of the second portion of said left side panel. A right side panel comprises a first portion integral with the first portion of the top panel and connected thereto by a fold line, a second portion integral with the bottom panel and connected thereto by a fold line, a third portion integral with the second portion of the top panel and connected thereto by a fold line, a first glue tab panel integral with the glue tab panel integral with the first portion of the top panel and connected thereto by a fold line and secured to a portion of the third portion of the right side panel, a second glue tab panel integral with the front panel and connected thereto by a fold line and secured to a portion of the first and third portions of the right side panel and a third glue tab panel integral with the back panel and connected thereto by a fold line and secured to portions of the second and third portions of the right side panel.

Two spaced apart series of perforations are formed in the back panel and extend into the second portion of the top panel for forming a continuous series of perforations so that an opening may be formed in the carton.

A series of perforations are formed in the first portion of the right side panel and extend into the first portion of the top panel and a series of perforations are formed in the third portion of the right side panel and extend into the second portion of the top panel for forming an opening in the carton.

Two series of perforations are formed in the second portion of the right side panel, a series of perforations are formed in the second glue tab panel of the right side section and a series of perforations are formed in the third glue tab panel of the right side section for forming an opening in the carton.

A series of perforations are formed in the first portion of the left side panel and extend into the first portion of the top panel and a series of perforations are formed in the second portion of the left side panel and extend into the bottom panel for forming openings in the carton.

A pull tab is formed on the second portion of the top panel. A pull string is secured to the second portion of the top panel, the back panel, the bottom panel, the front panel, the first portion of the top panel and the glue panel. The pull string is secured to the pull tab for forming an opening in the carton.

BRIEF DESCRIPTION OF THE DRAWINGS

An illustrative and presently preferred embodiment of the invention is illustrated in the drawings in which.

DETAILED DESCRIPTION OF THE INVENTION

Figure 1:
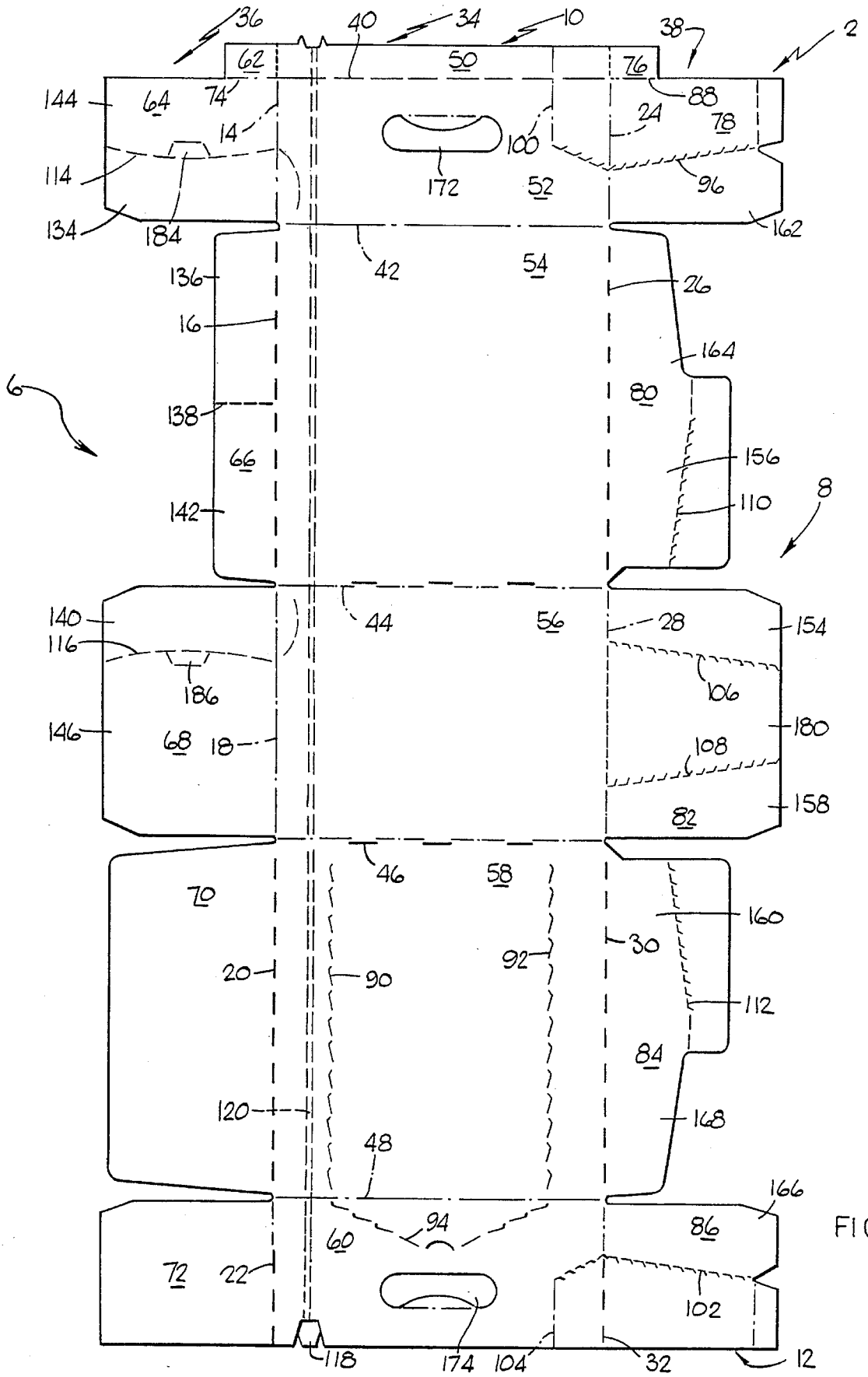
FIG. 1 is a top plan view of a carton blank of this invention.
Figure 2:
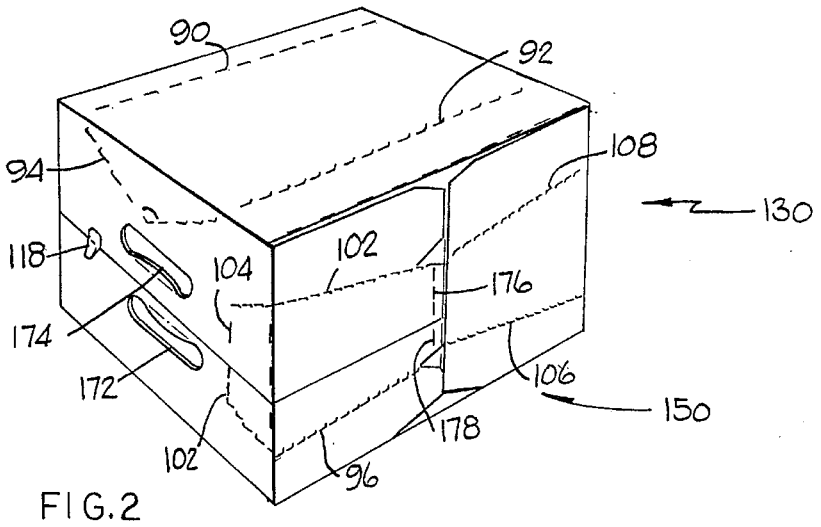
FIG. 2 is a perspective view of a carton of this invention.
Figure 3:
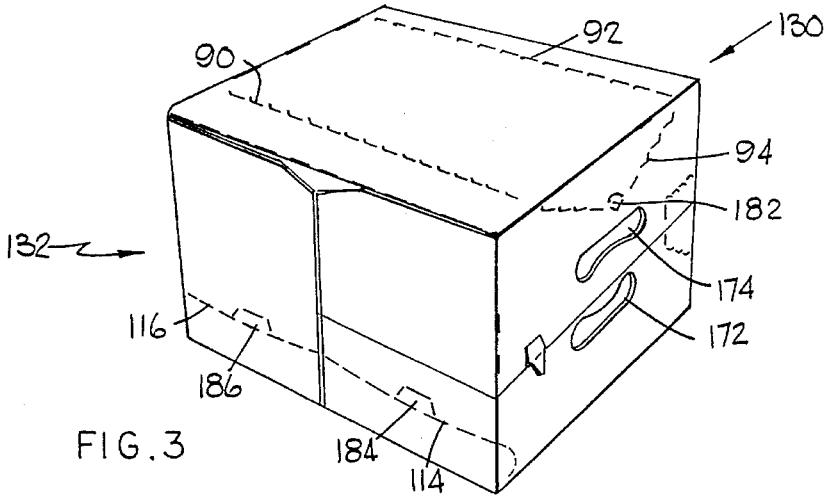
FIG. 3 is another perspective view of the carton of this invention.

A carton blank 2 is illustrated in FIG. 1 and has a left side edge 6, a right side edge 8, a top edge 10 and a bottom edge 12. A first plurality of longitudinally extending fold lines 14, 16, 18, 20 and 22 cooperate with a second plurality of longitudinally extending fold lines 24, 26, 28, 30 and 22 to divide the carton blank 2 into a center section 34, a left side section 36 and a right side section 38.

The center section 34 has a plurality of transversely extending fold lines 40, 42 44, 46 and 48 for dividing the center section from the top edge 10 to the bottom edge 12 into a glue tab panel 50, a first portion 52 of a top panel, a front panel 54, a bottom panel 56, a back panel 58 and a second portion 60 of the top panel. Lines 44 and 46 are also cut lines.

The left side section 36 is divided from the top edge 10 to the bottom edge 12 into a first glue tab panel 62, a first portion 64 of a left side panel, a second glue tab panel 66, a second portion 68 of the left side panel, a third glue tab panel 70 and a third portion 72 of the left side panel. A cut line 74 is between the first glue tab panel 62 and the first portion 64 of the left side panel.

The right side section 38 is divided from the top edge 10 to the bottom edge 12 into a first glue tab panel 76, a first portion of a right side panel 78, a second glue tab panel 80, a second portion 82 of the right side panel, a third glue tab panel 84 and a third portion 86 of the right side panel. A cut line 88 is between the first glue tab panel 76 and the first portion 78 of the right side panel.

Two spaced apart series of perforations 90 and 92 are formed in the back panel 58 and extend into the second portion 60 of the top panel for forming a continuous series of perforations 94 for forming an opening in a carton formed from the carton blank 2.

A series of perforations 96 are formed in the first portion 78 of the right side panel and extend into the first portion 52 of the top panel to a fold line 100 and a series of perforations 102 are formed in the third portion 86 of the right side panel and extend into the second portion 60 of the top panel to fold line 104 and cooperate to form an opening in a carton formed from the carton blank 2.

Two series of perforations 106 and 108 are formed in the second portion 82 of the right side panel, a series of perforations 110 are formed in the second glue tab panel 80 and the right side section and a series of perforations 112 are formed in the third glue tab panel 84 of the right side section and are used to form an opening in a carton formed from the carton blank 2.

A series of perforations 114 are formed in the first portion 64 of the left side panel and extend into the first portion 52 of the top panel and a series of perforations 116 are formed in the second portion 68 of the left side panel and extend into the bottom panel 56 and are used to form openings in a carton formed from the carton blank 2.

A pull tab 118 is formed on the second portion 60 of the top panel. A pull string 120 is secured to the second portion 60 of the top panel, the back panel 58, the bottom panel 56, the front panel 54, the first portion 52 of the top panel and the glue tab panel 50. The pull string 120 is secured to the pull tab 118 and they are used to form an opening in a carton formed from the carton blank 2.

A carton 130 is formed from the carton blank 2 by folding the carton blank 2 around fold lines 42, 44, 46 and 48 and gluing a manufacturer's joint between the glue tab panel 50 and a portion of the second portion 60 of the top panel. The left side panel 132 is formed by gluing the portion 134 of the first portion 64 to the portion 136 of the second glue tab panel 66. A cut line 138 is formed in the second glue tab panel 66. The portion 140 of the second portion 68 is glued to the portion 142 of the second glue tab panel 166. The portion 144 of the first portion 64, the portion 146 of the second portion 68 and the third portion 72 are glued to the third glue tab panel 70.

The right side panel 150 is left open until the beverage containers 152 are placed into the carton 130. The right side panel 150 is formed by gluing the portion 154 of the second portion 82 to the portion 156 of the second glue tab panel 80 so that the perforations 106 and 110 are superposed. The portion 158 of the second portion 82 is glued to the portion 160 of the third glue tab panel 84 so that the perforations 108 and 112 are superposed. The portion 162 of the first portion 78 is glued to the portion 164 of the second glue tab panel 80 and the portion 166 of the third portion 86 is glued to the portion 168 of the third glue tab panel 84.

Figure 4:
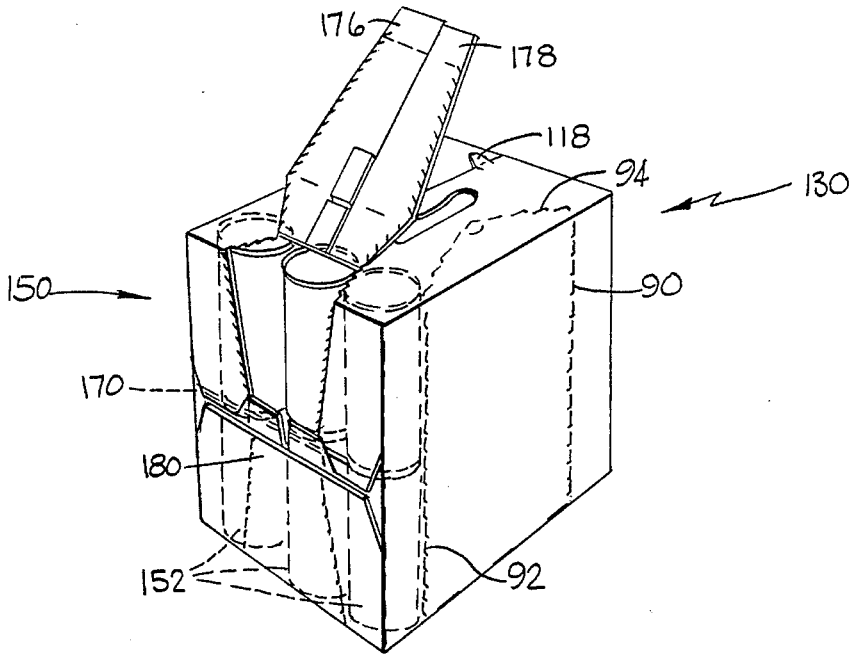
FIG. 4 is another perspective view of the carton of this invention and illustrating one of the openings that may be formed therein.

As illustrated in FIG. 4, the beverage containers 152 are loaded into the carton 130 in two layers separated by a sheet 170. Cut outs 172 and 174 are made in the first and second portions 52 and 60 to function as a handle.

There are many ways to form an opening in the carton 130. In FIG. 4, an opening is formed by grasping the tabs 176 and 178 and pulling outwardly and upwardly to sever the perforations 96 and 102 and folding around the fold lines 100 and 104. Another opening can be formed by grasping the edge portion 180 and pulling outwardly and downwardly to sever the perforations 106 and 108 and folding around the fold line 28. An opening can be formed by grasping the tab 182 and pulling outwardly and upwardly to sever the perforations 90, 92 and 94 and severing along fold and cut line 46. An opening can be formed by grasping tab 184 and pulling outwardly and downwardly to sever the perforations 114 and the cut line 138. An opening can be formed by grasping the tab 186 and pulling outwardly and downwardly to sever along the perforations 116. An opening can be formed by grasping the pull tab 118 and pulling it around the second portion 60, the back panel 58, the bottom panel 56, the front panel 54 and the first portion 52 so that they are severed by the pull string 120.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A carton blank comprising:

a unitary sheet of material having a left side edge, a right side edge, a top edge and a bottom edge;

a first plurality of fold lines extending from said top edge to said bottom edge;

a second plurality of fold lines extending from said top edge to said bottom edge;

said first and second plurality of fold lines dividing said unitary sheet of material into a center section, a left side section and a right side section;

said center section having a plurality of transversely extending fold lines for dividing said center section from said top edge to said bottom edge into a glue tab panel, a first portion of a top panel, a front panel, a bottom panel, a back panel and a second portion of said top panel;

said left side section being divided from said top edge to said bottom edge into a first glue tab panel, a first portion of a left side panel, a second glue tab panel, a second portion of said left side panel, a third glue tab panel and a third portion of said left side panel;

a cut line between said first glue tab panel and said first portion of said left side panel;

said right side section being divided from said top edge to said bottom edge into a first glue tab panel, a first portion of a right side panel, a second glue tab panel, a second portion of said right side panel, a third glue tab panel and a third portion of said right side panel;

a cut line between said first glue tab panel of said right side panel and said first portion of said right side panel;

two spaced apart series of perforations in said back panel and extending into said second portion of said top panel for forming a continuous series of perforations for forming an opening in a carton formed from said carton blank;

a series of perforations in said first portion of said right side panel extending into said first portion of said top panel and a series of perforations in said third portion of said right side panel and extending into said second portion of said top panel for forming an opening in a carton formed from said carton blank; and two series of perforations formed in said second portion of said right side panel, a series of perforations in said second glue tab panel of said right side section and a series of perforations in said third glue tab panel of said right side section for forming an opening in a carton formed from said carton blank.

2. A carton blank as in claim 1 and further comprising:

a series of perforations in said first portion of said left side panel extending into said first portion of said top panel and a series of perforations in said second portion of said left side panel extending into said bottom panel for forming openings in a carton formed from said carton blank.

3. A carton blank as in claim 2 and further comprising:

a pull tab formed on said second portion of said top panel;

a pull string secured to said second portion of said top panel, said back panel, said bottom panel, said front panel, said first portion of said top panel and said glue tab panel; and said pull string secured to said pull tab for forming an opening in a carton formed from said carton blank.

4. A carton blank as in claim 1 and further comprising:

a pull tab formed on said second portion of said top panel;

a pull string secured to said second portion of said top panel, said back panel, said bottom panel, said front panel, said first portion of said top panel and said glue tab panel; and said pull string secured to said pull tab for forming an opening in a carton formed from said carton blank.

5. A carton having different series of perforations so that a variety of openings may be formed in the carton comprising:

a top wall panel comprising first and second portions secured together by a glue tab panel;

a front panel integral with said first portion of said top panel and connected thereto by a fold line;

a bottom panel integral with said front panel and connected thereto by a fold line;

a back panel integral with said bottom panel and connected thereto by a fold line;

said back panel being integral with said second portion of said top panel and connected thereto by a fold line;

a left side panel comprising a first portion integral with said first portion of said top panel and connected thereto by a fold line, a second portion integral with said bottom panel and connected thereto by a fold line, a third portion integral with said second portion of said top panel and connected thereto by a fold line, a first glue tab panel integral with said glue tab panel integral with said first portion of said top panel and connected to said glue tab panel integral with said first portion of said top panel by a fold line and secured to a portion of said third portion of said left side panel, a second glue tab panel integral with said front panel and connected thereto by a fold line and secured to portions of said first and second portions of said left side panel and a third glue tab panel integral with said back panel and connected thereto by a fold line and secured to said third portion and a portion of said second portion of said left side panel;

a right side panel comprising a first portion integral with said first portion of said top panel and connected thereto by a fold line, a second portion integral with said bottom panel and connected thereto by a fold line, a third portion integral with said second portion of said top panel and connected thereto by a fold line, a first glue tab panel integral with said glue tab panel integral with said first portion of said top panel and connected to said glue tab panel integral with said first portion of said top panel by a fold line and secured to a portion of said third portion of said right side panel, a second glue tab panel integral with said front panel and connected thereto by a fold line and secured to a portion of said first and third portions of said right side panel and a third glue tab panel integral with said back panel and connected thereto by a fold line and secured to portions of said second and third portions of said right side panel;

two spaced apart series of perforations in said back panel and extending into said second portion of said top panel for forming a continuous series of perforations so that an opening may be formed in said carton;

a series of perforations in said first portion of said right side panel and extending into said first portion of said top panel and a series of perforations in said third portion of said right side panel extending into said second portion of said top panel for forming an opening in said carton; and two series of perforations formed in said second portion of said right side panel, a series of perforations in said second glue tab panel of said right side section and a series of perforations formed in said third glue tab panel of said right side section for forming an opening in said carton.

6. A carton as in claim 5 and further comprising:

a series of perforations in said first portion of said left side panel extending into said first portion of said top panel and a series of perforations in said second portion of said left side panel extending into said bottom panel for forming openings in said carton.

7. A carton as in claim 6 and further comprising:

a pull tab formed on said second portion of said top panel;

a pull string secured to said second portion of said top panel, said back panel, said bottom panel, said front panel, said first portion of said top panel and said glue tab panel; and said pull string secured to said pull tab for forming an opening in said carton.

8. A carton as in claim 5 and further comprising:

a pull tab formed on said second portion of said top panel;

a pull string secured to said second portion of said top panel, said back panel, said bottom panel, said front panel, said first portion of said top panel and said glue tab panel; and said pull string secured to said pull tab for forming an opening in said carton.

* * * * *